US010118675B2

(12) United States Patent
Strong

(10) Patent No.: US 10,118,675 B2
(45) Date of Patent: Nov. 6, 2018

(54) DEVICE FOR TRANSFERRING PERSONS

(71) Applicant: REFLEX MARINE LTD, Cornwall (GB)

(72) Inventor: Philip Anton Strong, Exeter (GB)

(73) Assignee: REFLEX MARINE LTD., Cornwall (GB)

( * ) Notice: Subject to any disclaimer, the term of this patent is extended or adjusted under 35 U.S.C. 154(b) by 0 days.

(21) Appl. No.: 15/038,384

(22) PCT Filed: Nov. 20, 2014

(86) PCT No.: PCT/EP2014/075107
§ 371 (c)(1),
(2) Date: May 20, 2016

(87) PCT Pub. No.: WO2015/075114
PCT Pub. Date: May 28, 2015

(65) Prior Publication Data

US 2016/0288881 A1 Oct. 6, 2016

(30) Foreign Application Priority Data

Nov. 21, 2013 (EP) ..... 13193860

(51) Int. Cl.

| | |
|---|---|
| ***B63B 27/00*** | (2006.01) |
| ***B63B 35/00*** | (2006.01) |
| ***B65G 67/60*** | (2006.01) |
| ***B63B 27/10*** | (2006.01) |
| ***B63B 27/16*** | (2006.01) |

(52) U.S. Cl.
CPC ..... *B63B 27/10* (2013.01); *B63B 27/16* (2013.01)

(58) Field of Classification Search
CPC ..... B63B 27/10; B63B 27/16
USPC ..... 414/139.5, 803, 137.1, 138.2; 114/350, 114/363, 362
See application file for complete search history.

(56) References Cited

U.S. PATENT DOCUMENTS

| | | | | |
|---|---|---|---|---|
| 4,700,632 | A * | 10/1987 | Schmutz | A63G 7/00 104/53 |
| 5,713,710 | A * | 2/1998 | Strong | B63B 27/10 114/350 |
| 7,556,471 | B1 * | 7/2009 | Gallagher | B63B 27/00 414/139.5 |
| 8,439,622 | B2 * | 5/2013 | Strong | B63B 27/16 114/363 |
| 2001/0018015 | A1 * | 8/2001 | Johnson | B63B 27/16 414/139.5 |
| 2009/0285657 | A1 * | 11/2009 | Strong | B63B 27/16 414/139.5 |

(Continued)

OTHER PUBLICATIONS

Extended European Search Report issued in EP 13 19 3860 dated Apr. 11, 2014.

*Primary Examiner* — Rakesh Kumar
(74) *Attorney, Agent, or Firm* — Kramer Amado, P.C.

(57) ABSTRACT

The invention provides a transfer device (1) comprising, a seating assembly, floatation means (5) and a primary lifting point (6). The seating assembly comprises a base (2), a central bearing structure (3) and a plurality of seats (4). The primary lifting point (6) is suitable for receiving a main line. The central bearing structure (3) comprises a suspension system, for providing suspension and damping to said central bearing structure (3).

14 Claims, 3 Drawing Sheets

(56) References Cited

U.S. PATENT DOCUMENTS

2011/0018015 A1 1/2011 Epler
2016/0288881 A1* 10/2016 Strong ..... B63B 27/10

* cited by examiner

DEVICE FOR TRANSFERRING PERSONS

TECHNICAL FIELD OF THE INVENTION

The present invention belongs to the field of marine transfer devices, and more particularly, to the field of transfer of personnel between marine vessels and offshore structure by crane in.

BACKGROUND OF THE INVENTION

In the field of transfer devices, there are several devices that provide the possibility of moving people from one place to another, by means of a crane or davit.

The most typical devices are the basket-type devices. Several options can be found in this kind of devices. The most commonly known is the "Billy Pugh" device, which is a rope basket with a solid base. This is a very basic choice, as people to be transferred are just standing and need to hold on to the device, with no security attachments, no ergonomic positioning nor any protection against external impacts.

Other devices, such as those described in documents U.S. Pat. No. 5,713,710, describe improved devices adapted to transfer objects which can be secured or even a seating assembly to provide a quite comfortable and useful position for people who are being transferred.

Nevertheless, these devices provide limited protection during the transfer, which may compromise safety in challenging environments such as harsh weather areas.

SUMMARY OF THE INVENTION

The present invention provides an alternative solution for the aforementioned problems, by a transfer device according to claim 1. In dependent claims, preferred embodiments of the invention are defined.

In a first inventive aspect, the invention provides a transfer device comprising,

- a seating assembly, comprising a base, a central bearing structure and a plurality of seats,
- floatation means,
- a primary lifting point located within the central bearing structure between the seats and the top end of said central bearing structure, the top end being that which is farthest from the base, the primary lifting point being adapted for receiving a main line, wherein the central bearing structure comprises a suspension system, for providing suspension and damping to said central bearing structure.

Advantageously, the suspension system provides protection against vertical impacts of heavy landings.

In a particular embodiment, the suspension system comprises at least one primary spring assembly and at least one damper assembly.

In a particular embodiment, the central bearing structure comprises at least one load column, said at least one load column comprising a guiderail system for allowing one part of the load column to be housed inside the other part of the load column.

In a particular embodiment, the primary spring assembly comprises a primary spring, a telescopic bar, a sliding sleeve and a sliding sleeve stopper; the primary spring being located between a node plate of the central bearing structure and the at least one load column.

In a particular embodiment, the damper assembly comprises a damper and a damper support.

In a particular embodiment, the at least one load column comprises a seat anchoring piece having a regular polygon cross section, adapted to attach each seat to the at least one load column.

In a particular embodiment, the central bearing structure comprises two columns.

In a particular embodiment, the transfer device further comprises rigidity bars.

In a particular embodiment, the transfer device further comprises a load plate, said load plate being attached to the central bearing structure and comprising the primary lifting point.

In a particular embodiment, the first lifting point is a hole comprised in the load plate.

In a particular embodiment, the transfer device further comprises at least one secondary lifting point.

In a particular embodiment, this secondary lifting point is a hole in a load plate.

In a particular embodiment, the floating means comprise polyethylene buoyancy panels.

In a particular embodiment, the seat anchoring piece is located at least at 650 mm from the base of the seating assembly, and no seat has lateral thigh support. Advantageously, this feature allows the passenger to rotate his legs further than 90 degrees.

In a particular embodiment, at least one seat is adapted to be removed easily from the central bearing structure.

In a particular embodiment, at least one part of a seat is suitable for being folded around a hinge.

In a particular embodiment, the transfer device further comprises base protections.

All the features described in this specification (including the claims, description and drawings) and/or all the steps of the described method can be combined in any combination, with the exception of combinations of such mutually exclusive features and/or steps.

DESCRIPTION OF THE DRAWINGS

These and other characteristics and advantages of the invention will become clearly understood in view of the detailed description of the invention which becomes apparent from a preferred embodiment of the invention, given just as an example and not being limited thereto, with reference to the drawings.

DETAILED DESCRIPTION OF THE INVENTION

Figure 1:
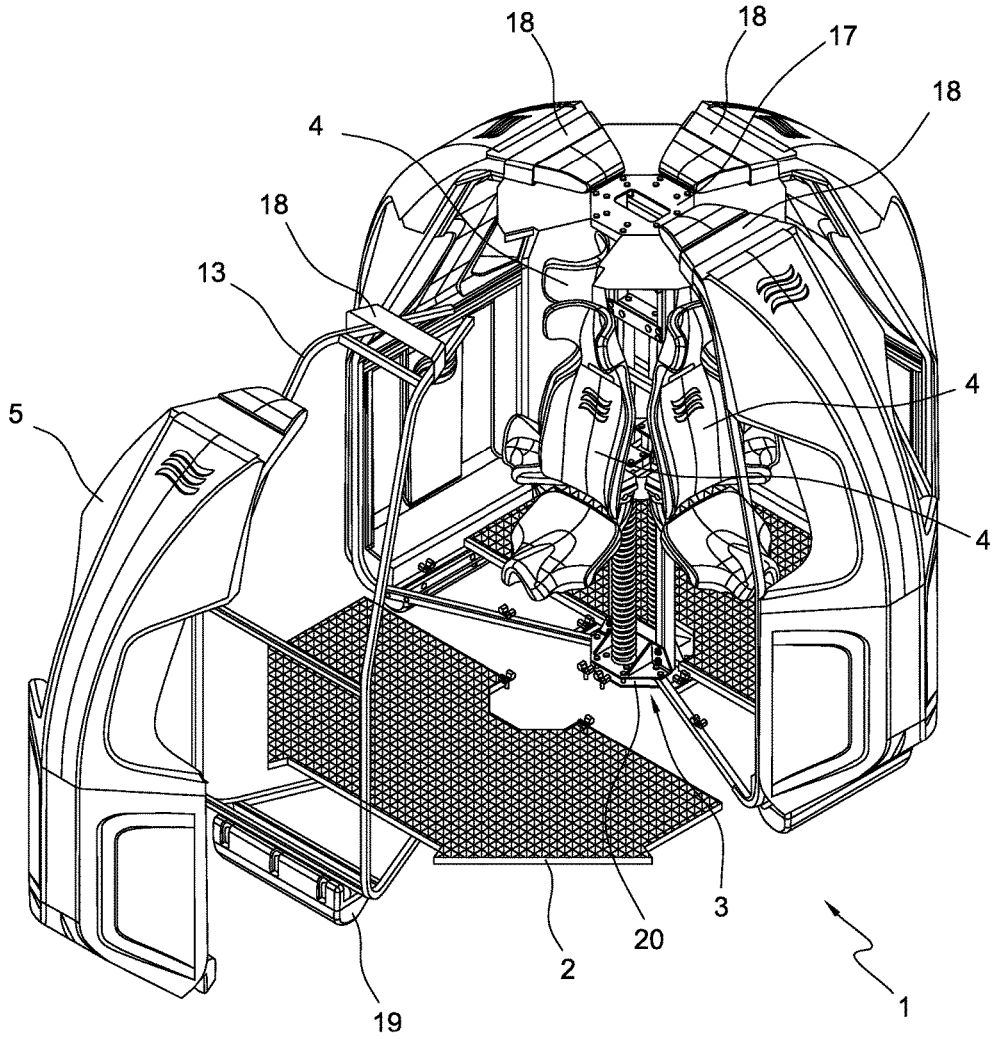
FIG. 1 This figure shows a perspective an exploded view of a transfer device.

The FIG. 1 shows an exploded view of a particular embodiment of a transfer device (1) according to the invention. In this view, the main features of this transfer device (1) are shown.

The transfer device (1) first comprises a seating assembly (2*a*). This seating assembly provides seating for the passengers being transferred by the transfer device (1).

This seating assembly (2*a*) comprises a base (2), a central bearing structure (3) and a plurality of seats (4). Each of these elements comprises in turn other elements and features, which are presented and described below.

In this particular embodiment, the base (2) is an essentially flat, rigid structure, comprising perforations which account for more than the 30% of the total area of said surface, thus providing flow passage between both sides thereof. In a particular embodiment, this configuration is achieved by a lattice structure. Advantageously, this allows the transfer device (1) to be partially submerged without presenting a high drag.

The central bearing structure (3) is the central element of the transfer device (1). It provides support and bears the loads due to the lifting or landing. It comprises, among other elements, a cap plate (17), which is placed in the top end of the central bearing structure (3). This top end is the end which is farthest from the base (2). This cap plate (17) provides a centralized anchoring point for the different elements that are intended to be attached to the top of the transfer device (1). The central bearing structure (3) also comprises a node plate (20) where the base (2) is attached.

The transfer device also comprises rigidity bars (13). In this embodiment, these rigidity bars (13) improve the rigidity of the transfer device (1) by connecting the cap plate (17) with the base (2) by an alternative path. This path is not the main load path, but improves the mechanical behavior of the whole transfer device (1). These rigidity bars (13) are also used in this embodiment as a base where other elements are attached. Further, these rigidity bars (13) provide protection to the passengers of the transfer device (1) against vertical and side impacts.

The transfer device also comprises floatation means (5). In this particular embodiment, these floatation means (5) are polyethylene buoyancy panels, and are attached to the rigidity bars (13). They are also attached to the cap plate (17) by means of some clamping plates (18). Advantageously, the shape, material and position of these floatation means (5) permit the self-righting of the transfer device (1) when it is capsized. In a particular embodiment, these floatation means (5) comprise cutaways, enhancing the visibility of the passengers of the transfer device (1).

The transfer device (1) also comprises base protections (19), which provide protection to the base in the lifting and landing operations.

Figure 2:
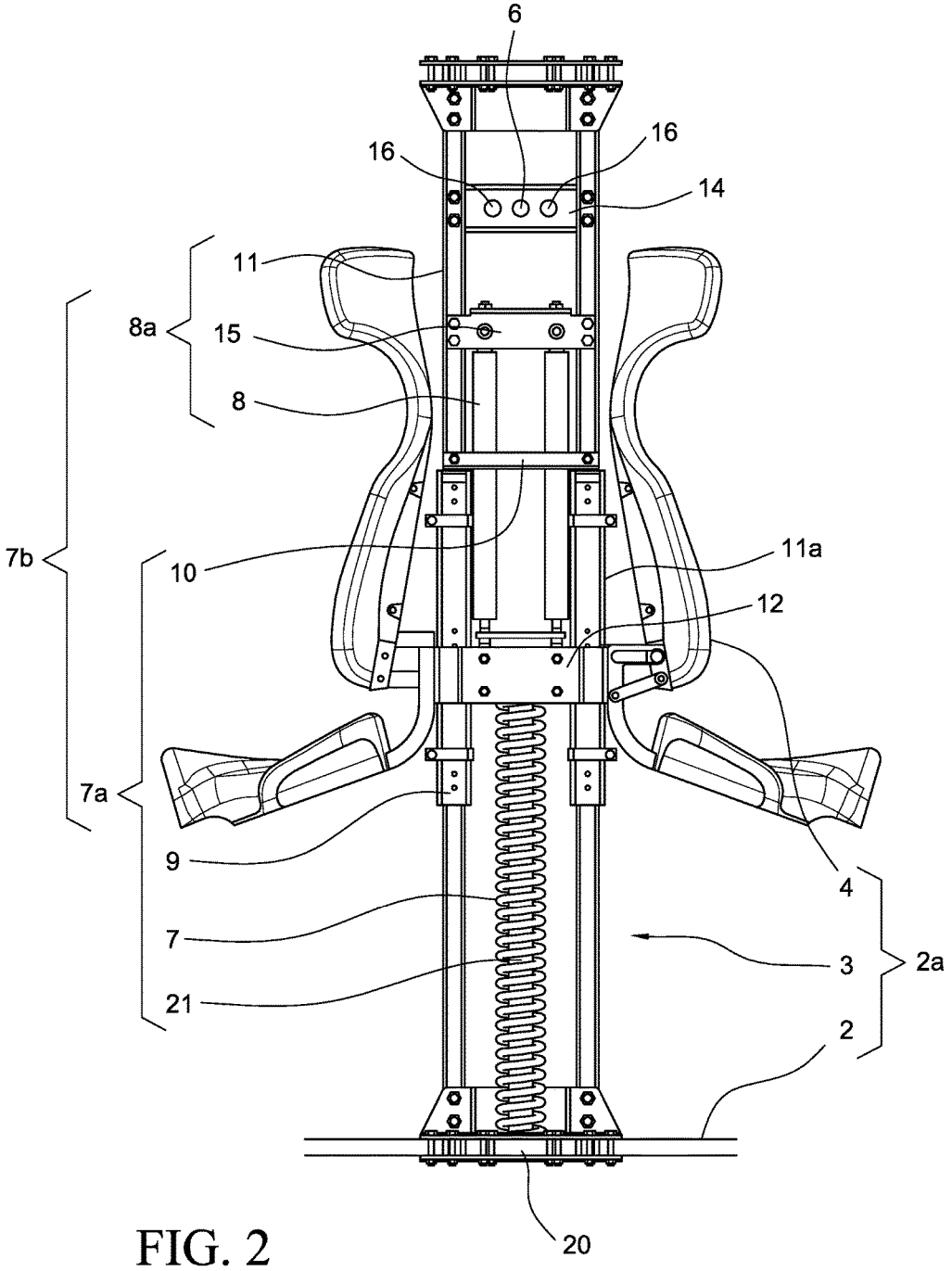
FIG. 2 This figure shows a frontal view from the central bearing structure.

The FIG. 2 shows a detailed view of the central bearing structure (3), allowing a better understanding of the elements comprised in it.

In this particular embodiment, the central bearing structure (3) comprises two load columns (11), attached to the node plate (20) by means of a suspension system. The central bearing structure (3) is attached to the suspension system by means of attaching means, such as nut and bolts, welding, bridle and the like, preferably nuts and bolts. The suspension system is in turn attached to the base (2) by attaching means. Advantageously, the two load columns provide a load path redundancy, so that the load is not transmitted by a single path, the failure of which would be critical, but by two columns, thus improving security and reliability of the transfer device (1). The two load columns (11) also provide the advantage of preventing rotation during the mounting of the seating assembly. In a particular embodiment, the two load columns (11) have a polygonal cross section, such as a square or a rectangle, which facilitates the attachment of any element to said load columns (11), providing a flat surface to carry out these attachments. Each load column (11) comprises a guiderail system (11*a*) that allows a portion of the load column (11) to be housed in the other portion of the load column (11) adapting the length of the load column (11) to the movement of the suspension system, where the guiderail system comprises a guiderail.

The seats (4) are attached to the central bearing structure (3) by means of a seat anchoring piece (12). This seat anchoring piece (12) encircles the load columns (11), and is attached to them, so that each seat (4) is attached to the seat anchoring piece (12) by the bottom part of its back. The seat anchoring piece (12) is located at least at 650 mm from the base (2). In a particular embodiment, no seat (4) has lateral thigh support. In a particular embodiment, the passengers are secured to the seats (4) by full body harnesses. Advantageously, these features permit a comfortable but useful position for being transferred, with the thighs of the passenger positioned in a semi-standing position greater than 90 degrees with respect to his trunk, but prevented from sliding from this position due to the provision of friction means in the seat base and the use of a full body harnesses. This position also allows the passenger to easily and quickly get in and out of the transfer device (1). In a particular embodiment, at least one seat (4) is adapted for being split off the central bearing structure (3). As each seat (4) is attached individually to the seat anchoring piece (12), this removal operation can be carried out without dismantling the whole central bearing structure (3). In a particular embodiment, at least one part of a seat (4) is suitable for being folded around a hinge.

The central bearing structure (3) also comprises a load plate (14). This load plate (14) comprises several lifting points (6, 16). The primary lifting point (6) is a hole, intended to receive a main line. The main line is a high performance rope, enabling the connection of the transfer device (1) to a towing element, such as a crane or davit. This main line is attached to the primary lifting point (6) and allows the transfer device (1) being lifted or towed.

The load plate (14) also provides secondary lifting points (16). One of these secondary lifting points (16) is used as a backup lifting point, being also prepared to receive a backup line, providing extra security to the lifting operation. Although in FIG. 2 the secondary lifting points are kept in a plane which is parallel to the base (2), in another embodiment these secondary lifting points (16) are placed in a different plane from the primary lifting point (6), so that the primary lifting point (6) receives the tension leg from the main line and a secondary lifting point (16) receives the slack. Another of these secondary lifting points (16) is suitable for receiving a handling line, thus providing means for rotating the transfer device (1) with respect of the axis of the central bearing structure (3).

The load plate (14) is located in the central bearing structure (3) between the two load columns (11), attached to both of said load columns (11) by means of attaching means such as nuts and bolts, welding, bridle and the like, preferably nuts and bolts. Said load plate (14) is placed between the seat anchoring piece (12) and the cap plate (17). Advantageously, this location of the load plate (14) allows to easily and quickly check whether the main line and the backup line are correctly secured or not and to inspect the safety critical connections. This location also helps to protect the load plate (14) and its attaching means from damage due to external impacts.

The load plate (14) is attached to the load columns (11) of the central bearing structure (3), thus transmitting the load from the main line to said central bearing structure (3).

The central bearing structure (3) also comprises a suspension system, for providing suspension and damping to said central bearing structure (3) with respect to the base (2).

This suspension system (7*b*) comprises a primary spring assembly (7*a*) and a damper assembly (8*a*).

The primary spring assembly (7*a*) is placed between the seating anchoring piece (12) and the base (2), thus providing the suspension for the seats (4). This primary spring assembly (7*a*) comprises a primary spring (7), a telescopic bar (21), a sliding sleeve (9) and a sliding sleeve stopper (10). The telescopic bar (21) is surrounded by the primary spring (7), and prevents the bucking of said primary spring (7).

The damper assembly (8*a*) provides absorption for the oscillating movement caused by the primary spring assembly. This damper assembly (8*a*) comprises a damper (8) in each load column (11) and a damper support (15).

Advantageously, this suspension system provides more comfort and security to the passengers inside the transfer device (1), reducing the effect of the impacts that landing and lifting may cause on these passengers.

Figure 3:
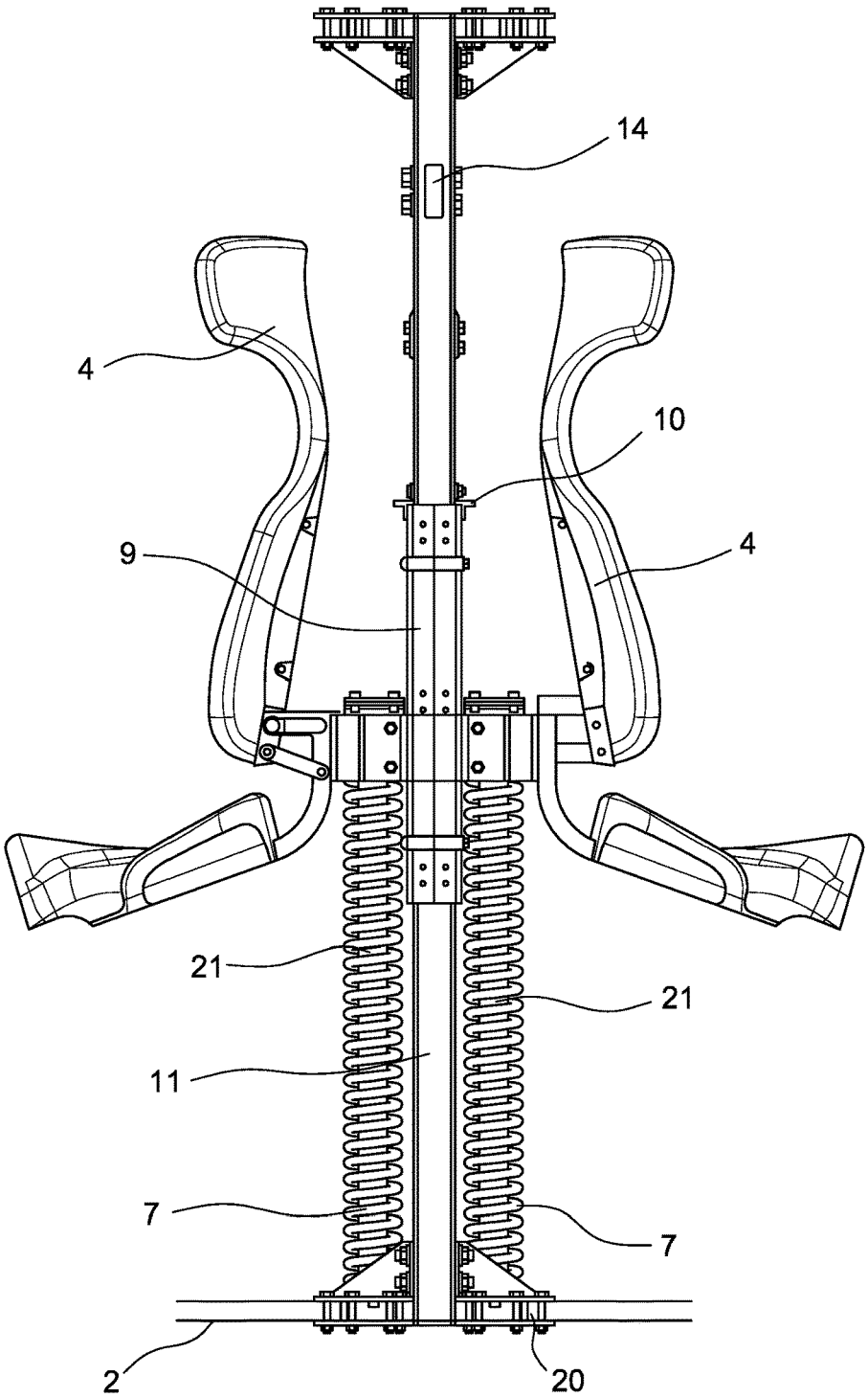
FIG. 3 This figure shows a side view of the central bearing structure.

FIG. 3 shows another side view of the central bearing structure (3). FIGS. 2 and 3 show the arrangement of the load columns (11) and the primary springs (7), which define the vertices of a square. This arrangement provides very good mechanical behaviour taking advantage of the available space between the seats (4).

The invention claimed is:

1. A transfer device comprising, a seating assembly, comprising a base, a central bearing structure and a plurality of seats, floatation means, a primary lifting point located within the central bearing structure between a top end of the seats and a top end of said central bearing structure, the top end of the central bearing structure being that which is farthest from the base, the primary lifting point being adapted for receiving a main line, wherein the central bearing structure comprises a suspension system, for providing suspension and damping to said central bearing structure, the suspension system comprising at least one primary spring assembly and at least one damper assembly, wherein the central bearing structure further comprises two load columns, each load column comprising a guiderail system running along the load column for allowing one part of said load column to be housed inside another part of the load column.

2. A transfer device according to claim 1, wherein the primary spring assembly comprises a primary spring, a telescopic bar, a sliding sleeve and a sliding sleeve stopper; the primary spring being located above a node plate of the central bearing structure and between the load columns.

3. A transfer device according to claim 1, wherein the damper assembly comprises a damper and a damper support.

4. A transfer device according to claim 1, wherein the load columns comprise a seat anchoring piece, adapted to attach each seat to the load columns.

5. A transfer device according to claim 1, further comprising rigidity bars and base protections.

6. A transfer device according to claim 1, further comprising a load plate, said load plate being attached to the central bearing structure and comprising the primary lifting point.

7. A transfer device according to claim 6, wherein the first lifting point is a hole comprised in the load plate.

8. A transfer device according to claim 7, further comprising at least one secondary lifting point.

9. A transfer device according to claim 8, said at least one secondary lifting point being a hole in a load plate.

10. A transfer device according to claim 1, wherein the flotation means comprises polyethylene buoyancy panels.

11. A transfer device according to claim 4, wherein the seat anchoring piece is located at least at 650 mm from the base of the seating assembly, and no seat has lateral thigh support.

12. A transfer device according to claim 1, wherein at least one part of a seat is suitable for being folded around a hinge.

13. A transfer device according to claim 1, further comprising at least one secondary lifting point.

14. A transfer device according to claim 1, wherein the load columns comprise a seat anchoring piece, adapted to attach each seat to the load columns, and wherein the primary spring assembly comprises a primary spring, a telescopic bar, a sliding sleeve and a sliding sleeve stopper, the primary spring being located between the seat anchoring piece and the base.

* * * * *